US008939794B2

(12) United States Patent
Mason et al.

(10) Patent No.: US 8,939,794 B2
(45) Date of Patent: Jan. 27, 2015

(54) COAXIAL CABLE ASSEMBLY

(75) Inventors: Jeffery Walter Mason, North Attleboro, MA (US); Wayne Stewart Alden, III, Whitman, MA (US)

(73) Assignee: Tyco Electronics Corporation, Berwyn, PA (US)

( * ) Notice: Subject to any disclaimer, the term of this patent is extended or adjusted under 35 U.S.C. 154(b) by 254 days.

(21) Appl. No.: 13/561,444

(22) Filed: Jul. 30, 2012

(65) Prior Publication Data

US 2014/0030917 A1 Jan. 30, 2014

(51) Int. Cl.

| | |
|---|---|
| ***H01R 9/05*** | (2006.01) |
| ***H01R 13/6594*** | (2011.01) |
| ***H01R 24/50*** | (2011.01) |

(52) U.S. Cl.

CPC ..... *H01R 24/50* (2013.01); *H01R 13/6594* (2013.01); *H01R 9/0515* (2013.01)

USPC ..... 439/581; 439/585

(58) Field of Classification Search

USPC ..... 439/581, 60, 660, 692, 924.1, 954

See application file for complete search history.

(56) References Cited

U.S. PATENT DOCUMENTS

| | | | | |
|---|---|---|---|---|
| 3,436,715 | A * | 4/1969 | Matthews | 439/77 |
| 3,980,382 | A * | 9/1976 | Reeder | 439/581 |
| 4,072,387 | A * | 2/1978 | Sochor | 439/329 |
| 5,402,088 | A * | 3/1995 | Pierro et al. | 333/33 |
| 6,250,953 | B1 * | 6/2001 | Niitsu | 439/497 |
| 6,321,126 | B1 * | 11/2001 | Kuzma | 607/137 |
| 6,692,262 | B1 * | 2/2004 | Loveless | 439/63 |
| 6,857,898 | B2 * | 2/2005 | Engquist et al. | 439/493 |
| 7,156,678 | B2 * | 1/2007 | Feldman et al. | 439/326 |
| 7,331,812 | B2 * | 2/2008 | Nishio et al. | 439/342 |
| 7,354,313 | B2 * | 4/2008 | Kumazawa et al. | 439/638 |
| 7,654,829 | B1 * | 2/2010 | Chuang et al. | 439/67 |
| 8,043,114 | B2 * | 10/2011 | Kaneko et al. | 439/497 |
| 8,172,613 | B1 | 5/2012 | Chen et al. | |
| 2011/0306229 | A1 * | 12/2011 | Katsui et al. | 439/345 |
| 2013/0280955 | A1 * | 10/2013 | Alden et al. | 439/607.28 |
| 2013/0303025 | A1 * | 11/2013 | Faith et al. | 439/620.21 |

* cited by examiner

*Primary Examiner* — Neil Abrams
*Assistant Examiner* — Travis Chambers

(57) ABSTRACT

A coaxial cable assembly includes a coaxial cable having a terminating end and a conductor being exposed at the terminating end. A cable housing holds the coaxial cable and has a conductor slot receiving the exposed conductor. A cable shield is coupled to the cable housing and provides electrical shielding for the terminating end of the coaxial cable. The cable housing is configured to be coupled to a circuit board such that the exposed conductor directly engages a signal pad of the circuit board for electrical connection thereto.

20 Claims, 7 Drawing Sheets

COAXIAL CABLE ASSEMBLY

BACKGROUND OF THE INVENTION

The subject matter herein relates generally to coaxial cable assemblies.

Coaxial cable assemblies typically include a connector terminated to an end of a coaxial cable. The connector includes a center contact terminated to an end of a center wire of the coaxial cable and a shielded body terminated to a cable braid or outer conductor of the coaxial cable. The connector is terminated to a complementary mating connector (e.g. plug and receptacle) having a mating contact held by the mating connector. The mating connector may be terminated directly to a circuit board to create an interface for the connector to electrically connect to the circuit board.

Such coaxial cable assemblies are not without disadvantages. For example, the system includes many components and interfaces between the signal pad of the circuit board and the center wire of the coaxial cable assembly. For example, a typical system will include three interfaces defined by 1) the circuit board and the mating contact, 2) the mating contact and the center contact, and 3) the center contact and the center wire. Each interface may cause signal degradation. Additionally, the mating connector and the connector of the coaxial cable assembly have a stack-up issue, increasing the overall height or profile above the circuit board. Some applications desire low-profile connectors. Furthermore, mounting the mating connector to the circuit board increases assembly time, such as for soldering the mating contact to the circuit board.

A need remains for a coaxial cable assembly that can be connected to a circuit board in a cost effective and reliable manner.

BRIEF DESCRIPTION OF THE INVENTION

In one embodiment, a coaxial cable assembly is provided having a coaxial cable having a terminating end and a conductor being exposed at the terminating end. A cable housing holds the coaxial cable and has a conductor slot receiving the exposed conductor. A cable shield is coupled to the cable housing and provides electrical shielding for the terminating end of the coaxial cable. The cable housing is configured to be coupled to a circuit board such that the exposed conductor directly engages a signal pad of the circuit board for electrical connection thereto.

Optionally, the conductor may be configured to be directly coupled to the signal pad of the circuit board at a separable interface. The conductor may include a center wire of the coaxial cable held within the conductor slot for directly engaging the signal pad. The conductor may include a center wire of the coaxial cable and a wedge contact terminated to the center wire with the wedge contact being held within the conductor slot for directly engaging the signal pad.

Optionally, the cable housing may include a nose at an end of the cable housing with the conductor slot provided at the nose and the conductor exposed at the nose for direct mounting to the signal pad. The cable housing may be spring biased against the circuit board with the exposed conductor being compressed against the signal pad when the cable housing is coupled to the circuit board. The cable shield may be electrically connected to an outer conductor of the coaxial cable. The cable housing may include a crown within the cable shield where a center wire of the coaxial cable is bent about the crown to define an apex configured to be compressed against the signal pad.

Optionally, the assembly may include a base shell configured to be mounted to the circuit board. The base shell may include a spring lever that is spring biased against at least one of the cable housing and the cable shield to press the exposed conductor against the signal pad. The cable housing may include a bottom configured to face the circuit board.

In another embodiment, a coaxial cable assembly is provided having a base shell configured to be coupled to a circuit board over a signal pad of the circuit board. The assembly also includes a coaxial cable having a terminating end with a conductor being exposed at the terminating end. A cable housing holds the coaxial cable and has a conductor slot receiving the exposed conductor. A cable shield is coupled to the cable housing and provides electrical shielding for the terminating end of the coaxial cable. The cable housing and cable shield are loaded into a cavity of the base shell and the base shell holds the cable housing such that the exposed conductor is configured to directly engage the signal pad of the circuit board for electrical connection thereto.

In a further embodiment, a coaxial cable assembly is provided having a coaxial cable having a terminating end. A conductor is exposed at the terminating end. The conductor includes a center wire of the coaxial cable and the conductor includes a wedge contact terminated to an end of the center wire. The assembly includes a cable housing holding the coaxial cable and having a conductor slot receiving the wedge contact. A cable shield is coupled to the cable housing and provides electrical shielding for the terminating end of the coaxial cable. The cable housing is configured to be coupled to a circuit board such that the wedge contact directly engages a signal pad of the circuit board for electrical connection thereto.

DETAILED DESCRIPTION OF THE INVENTION

Figure 1:
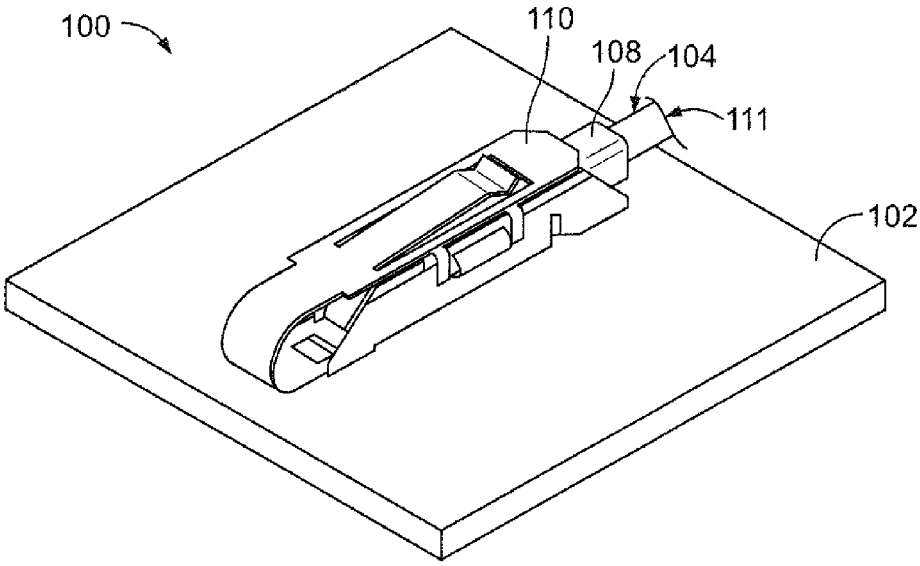
FIG. 1 is a top perspective view of a coaxial cable assembly formed in accordance with an exemplary embodiment.
Figure 2:
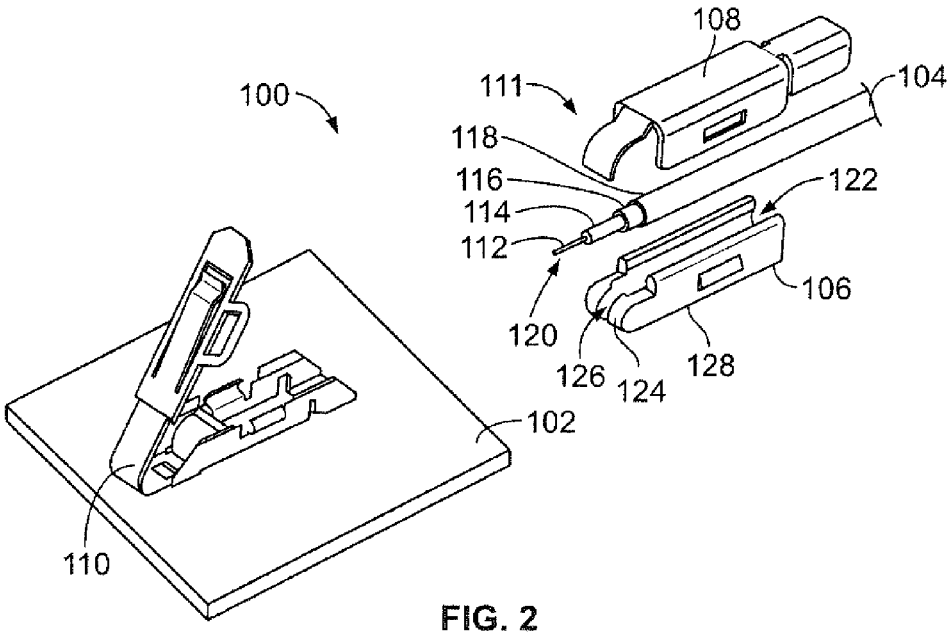
FIG. 2 is a partially exploded view of the coaxial cable assembly.

FIG. 1 is a top perspective view of a coaxial cable assembly 100 formed in accordance with an exemplary embodiment. FIG. 2 is a partially exploded view of the coaxial cable assembly 100. The coaxial cable assembly 100 is configured to be mounted to a circuit board 102. In an exemplary embodiment, the coaxial cable assembly 100 is directly connected to the circuit board 102 without the need for an intermediary connector therebetween.

The coaxial cable assembly 100 includes a coaxial cable 104, a cable housing 106, a cable shield 108 and a base shell 110. The coaxial cable 104, cable housing 106 and cable shield 108 define a cable subassembly 111 configured to be inserted into the base shell 110 to electrically terminate the coaxial cable 104 to the circuit board 102. The base shell 110 is mounted directly to the circuit board 102. The coaxial cable 104 is received in the cable housing 106 and the cable shield 108 is coupled to the cable housing 106 to provide electrical shielding for the coaxial cable 104. The coaxial cable 104, cable housing 106 and cable shield 108 are loaded into the base shell 110 to directly couple the coaxial cable 104 to the circuit board 102.

As shown in FIG. 2, the coaxial cable 104 includes a conductor 112, an insulator 114 surrounding the conductor 112, an outer conductor 116 surrounding the insulator 114 and a jacket 118 surrounding the outer conductor 116. In an exemplary embodiment, the conductor 112 is defined by a center wire of the coaxial cable 104, and may be referred to hereinafter as a center wire 112. The insulator 114 insulates the center wire 112 from the outer conductor 116. Optionally, the outer conductor 116 may be a cable braid, a foil, or another type of shield for the center wire 112. The coaxial cable 104 is prepared by stripping a terminating end 120 of the coaxial cable 104 to expose the center wire 112. Optionally, the outer conductor 116 may additionally be exposed at the terminating end 120.

The exposed portion of the conductor 112 is configured to be directly electrically connected to the circuit board 102. The exposed portion of the outer conductor 116 is configured to be electrically connected to the cable shield 108 and/or the base shell 110. In an exemplary embodiment, the base shell 110 presses against the cable shield 108 and/or cable housing 106 to press the center wire 112 against the circuit board 102 to make an electrical connection therewith. A separable, compressible electrical connection is made between the center wire 112 and the circuit board 102, such as to a signal pad on the circuit board 102.

The cable housing 106 includes a cable channel 122 that receives coaxial cable 104. Optionally, the coaxial cable 104 may be held in the cable channel 122 by an interference fit. Alternatively, retention features may be provided to secure the coaxial cable 104 within the cable channel 122. The cable channel 122 may be shaped to receive the coaxial cable 104. Optionally, the cable channel 122 may receive different diameter coaxial cables 104 to accommodate different size coaxial cables 104.

The cable housing 106 includes a nose 124 at a front end of the cable housing 106. A conductor slot 126 is provided at the nose 124. Optionally, the conductor slot 126 may be open at a front of the nose 124. Alternatively, the conductor slot 126 may be an internal passage through the nose 124. The conductor slot 126 receives the center wire 112 and may receive a portion of the insulator 114. Optionally, the conductor slot 126 may receive a portion of the outer conductor 116. During assembly, the terminating end 120 of the coaxial cable 104 is wrapped around the nose 124 such that the center wire 112 is received in the conductor slot 126. The center wire 112 wraps around a bottom 128 of the cable housing 106. The bottom 128 is generally opposite the cable channel 122. The cable housing 106 is received in the base shell 110 such that the bottom 128 extends along the circuit board 102. The exposed portion of the center wire 112 is exposed along the bottom 128 for terminating directly to the circuit board 102.

Figure 3:
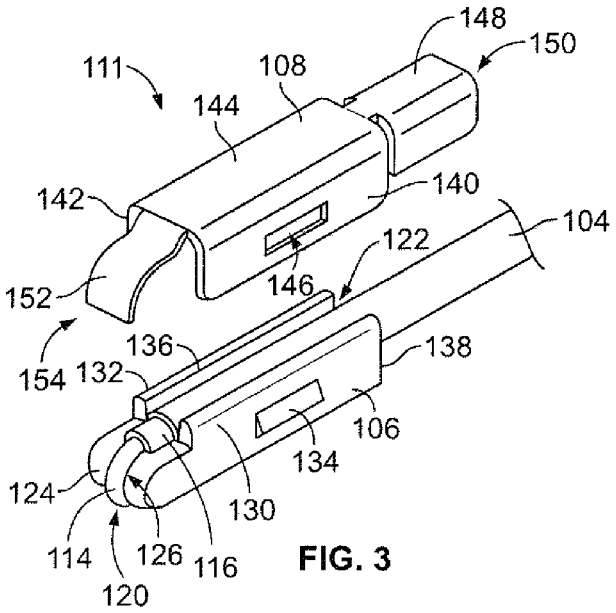
FIG. 3 is a partial exploded view of a portion of the coaxial cable assembly.

FIG. 3 is a partial exploded view of the cable subassembly 111. The coaxial cable 104 is illustrated coupled to the cable hosing 106. The coaxial cable 104 is received in the cable channel 122. The terminating end 120 of the coaxial cable 104 is wrapped around the nose 124 with the terminating end 120 received in the conductor slot 126. Optionally, the nose 124 may be rounded to provide a smooth transition for the coaxial cable 104. In an exemplary embodiment, a portion of the outer conductor 116 is exposed along the nose 124.

The cable housing 106 includes opposite sides 130, 132. The sides 130, 132 have catches 134 that extend outward therefrom. The catches 134 are used to secure the cable shield 108 to the cable housing 106. The sides 130, 132 extend to a top 136 of the cable housing 106. In an exemplary embodiment, the cable channel 122 is open through the top 136 such that the coaxial cable 104 may be loaded onto the cable channel 122 through the open top 136. Alternatively, the top 136 may be closed and the coaxial cable 104 may be loaded through a rear 138 of the cable housing 106.

The cable shield 108 is configured to be coupled to the cable housing 106. In an exemplary embodiment, the cable shield 108 is manufactured from a metal material, such as a copper material or another conductive material, to provide electrical shielding for the cable subassembly 111. In an exemplary embodiment, the cable shield 108 may be a stamped and formed part. The cable shield 108 includes sides 140, 142 and a top 144 extending between the sides 140, 142. Windows 146 are open through the sides 140, 142. The windows 146 receive the catches 134 when the cable shield 108 is coupled to the cable housing 106.

The cable shield 108 includes a strain relief 148 at a rear 150 of the cable shield 108. The strain relief 148 is configured to be coupled to the coaxial cable 104 to provide strain relief between the cable subassembly 111 and the coaxial cable 104. Optionally, the strain relief 148 may be crimped to the coaxial cable 104. Other securing means may be used in alternative embodiments to secure the cable shield 108 to the coaxial cable 104.

The cable shield 108 includes a spring finger 152 at a front 154 of the cable shield 108. The spring finger 152 extends along the nose 124. The spring finger 152 is configured to engage the exposed portion of the outer conductor 116 when the cable shied 108 is coupled to the cable housing 106. The spring finger 152 may be biased against the outer conductor 116 to ensure an electrical connection is maintain between the cable shield 108 and the outer conductor 116. The spring finger 152 may directly engage the nose 124. In an exemplary embodiment, the spring finger 152 is configured to engage the insulator 114 forward of the outer conductor 116. The spring finger 152 presses against the insulator 114 to hold the insulator 114 and conductor 112 (shown in FIG. 1) tightly within the conductor slot 126.

Figure 4:
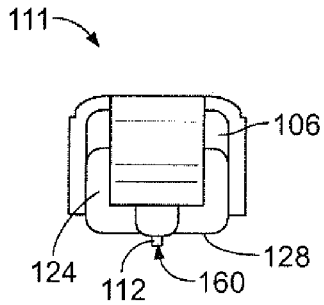
FIG. 4 is a front view of a cable subassembly formed in accordance with an exemplary embodiment.
Figure 5:
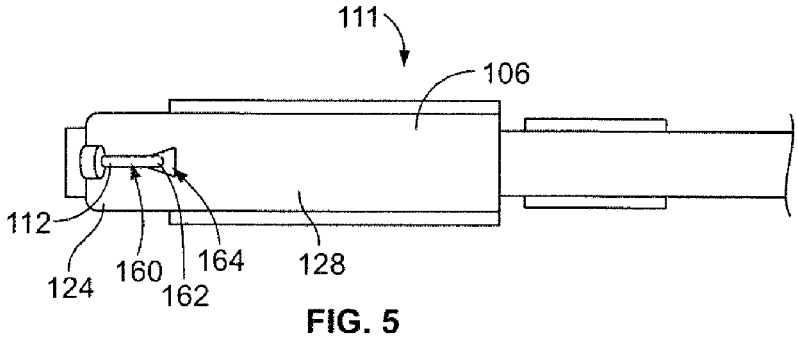
FIG. 5 is a bottom view of the cable subassembly.
Figure 6:
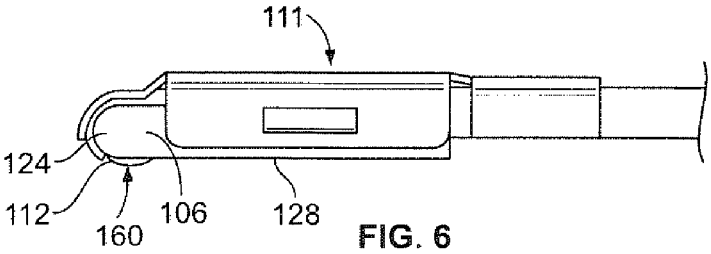
FIG. 6 is a side view of the cable subassembly.

FIG. 4 is a front view of the cable subassembly 111 formed in accordance with an exemplary embodiment. FIG. 5 is a bottom view of the cable subassembly 111. FIG. 6 is a side view of the cable subassembly 111. The conductor 112 is illustrated wrapped around the nose 124 of the cable housing 106 to the bottom 128 of the cable housing 106. The exposed portion of the conductor 112 is exposed at the bottom 128 for direct electrical connection to the circuit board 102 (shown in FIG. 1).

The exposed portion of the conductor 112 includes a mating interface 160 at the apex of the exposed portion of the conductor 112. The mating interface 160 is configured to be compressed against the circuit board 102. The mating interface 160 is separable from the circuit board 102. The mating interface 160 makes an electrical connection directly to the circuit board 102 without a soldered connection therebetween. The mating interface 160 makes an electrical connection with the circuit board 102 without another component or interface there between, such as a contact or terminal therebetween. A single interface is defined between the center wire 112 and the signal pad of the circuit board 102.

As shown in FIG. 5, an end 162 of the conductor 112 is secured to the cable housing 106. Optionally, the cable housing 106 may include a well 164 that receives the end 162 of the conductor 112. The end 162 may be secured within the well 164 by securing means or features, such as a deformation, dimpling or coining of the plastic material of the cable housing 106; by using epoxy to secure the end 162 and the well 164; or by using another component to secure the end 162 within the well 164.

Figure 7:
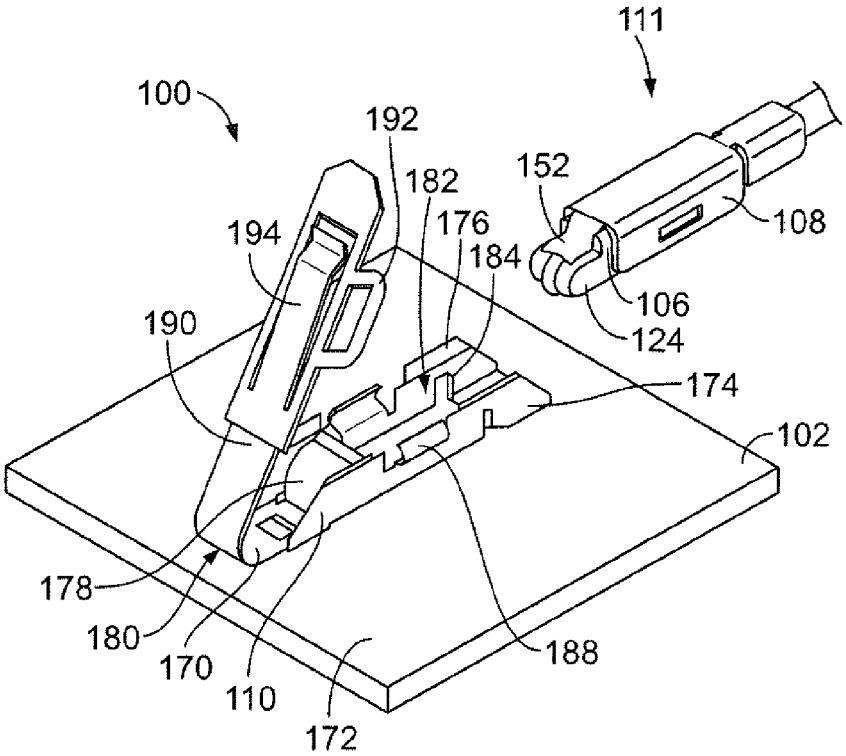
FIG. 7 illustrates the coaxial cable assembly showing the cable subassembly being loaded into a base shell.
Figure 8:
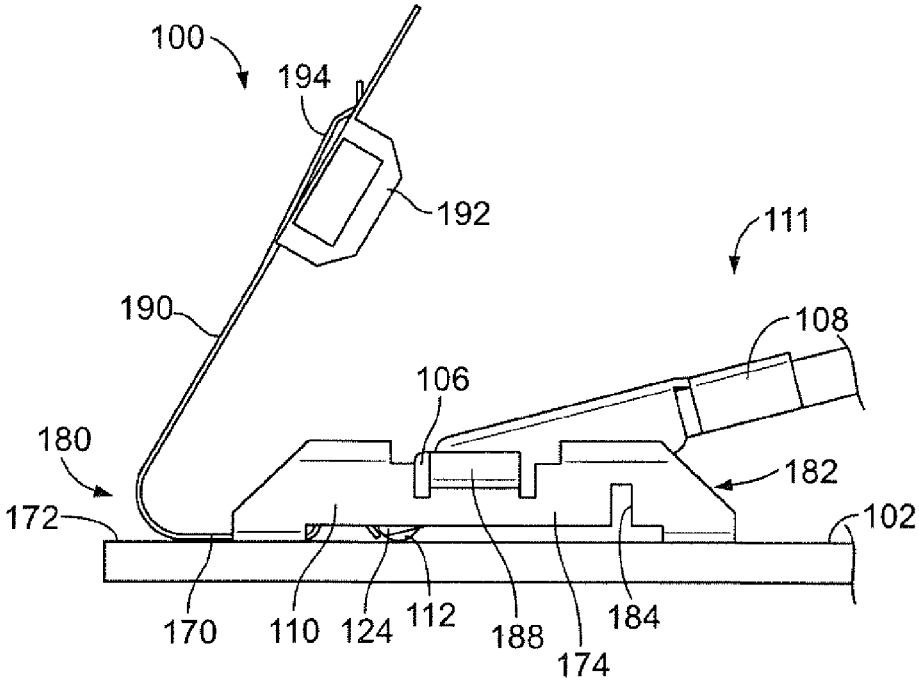
FIG. 8 is a side view of the coaxial cable assembly showing the cable subassembly being loaded into the base shell.

FIG. 7 illustrates the coaxial cable assembly 100 showing the cable subassembly 111 being loaded into the base shell 110. FIG. 8 is a side view of the coaxial cable assembly 100 showing the cable subassembly 111 being loaded into the base shell 110. The base shell 110 includes a base 170 coupled to a surface 172 of the circuit board 102. Optionally, the base 170 may be soldered to the surface 172. The base 170 may be secured to the surface 172 by other means or features in alternative embodiments, such as by using fasteners, interference tabs and the like. The base shell 110 includes side walls 174, 176 extending from the base 170.

The base shell 110 includes a spring lever 178 proximate to a front 180 of the base shell 110. A cavity 182 is defined between the side walls 174, 176 and the spring lever 178. The cavity 182 receives the cable subassembly 111. In an exemplary embodiment, the base shell 110 includes retention tabs 184 extending into the cavity 182 from the side walls 174, 176. The retention tabs 184 are located proximate to a rear of the base shell 110. The retention tabs 184 are configured to engage the cable subassembly 111 to hold the cable subassembly 111 within the cavity 182. For example, the retention tabs 184 are configured to engage the rear 138 of the cable housing 106 to restrict pull out of the cable subassembly 111 from the cavity 182. The retention tabs 184 resist reward movement of the cable subassembly 111 once the cable subassembly 111 is loaded into the cavity 182.

The base shell 110 includes latches 188 extending from the side walls 174, 176. The latches 188 are used to secure a cover 190 of the base shell 110 over the cable subassembly 111. The cover 190 extends from the front 180 of the base shell 110. In the illustrated embodiment, the cover 190 is pivotally coupled to the base 170. After the cable subassembly 111 is loaded into the cavity 182, the cover 190 is closed to hold the cable subassembly 111 in the cavity 182. The cover 190 includes latching tabs 192 that interact with the latches 188 to secure the cover 190 to the side walls 174, 176. Optionally, the cover 190 may press against the cable subassembly 111 to press the cable subassembly 111 against the circuit board 102.

In an exemplary embodiment, the cover 190 includes a grounding finger 194 that is configured to be spring biased against the cable shield 108. The grounding finger 194 electrically couples the base shell 110 to the cable shield 108. The grounding finger 194 may impart a spring force against the top of the cable subassembly 111 to press the cable subassembly downward against the circuit board 102.

During assembly, the cable subassembly 111 is plugged into the base shell 110. Optionally, the cable subassembly 111 may be loaded into the cavity 182 at an angle and then rotated into final position. The nose 124 is loaded into the cavity 182 under the spring lever 178. The spring lever 178 engages a top of the nose 124 to press the cable subassembly 111 downward into the circuit board 102. In an exemplary embodiment, the spring lever 178 engages the spring finger 152 on the cable shield 108 to electrically connect the base shell 110 to the cable shield 108. In an exemplary embodiment, the spring lever 178 imparts a vertically downward force onto the cable subassembly 111 directly above the exposed portion of the wire 112 (shown in FIG. 2) to press the center wire 112 into the circuit board 102, such as into a signal pad of the circuit board 102. A compressible connection is made between the center wire 112 and the circuit board 102. The compression is imparted, at least in part, by the spring lever 178.

Figure 9:
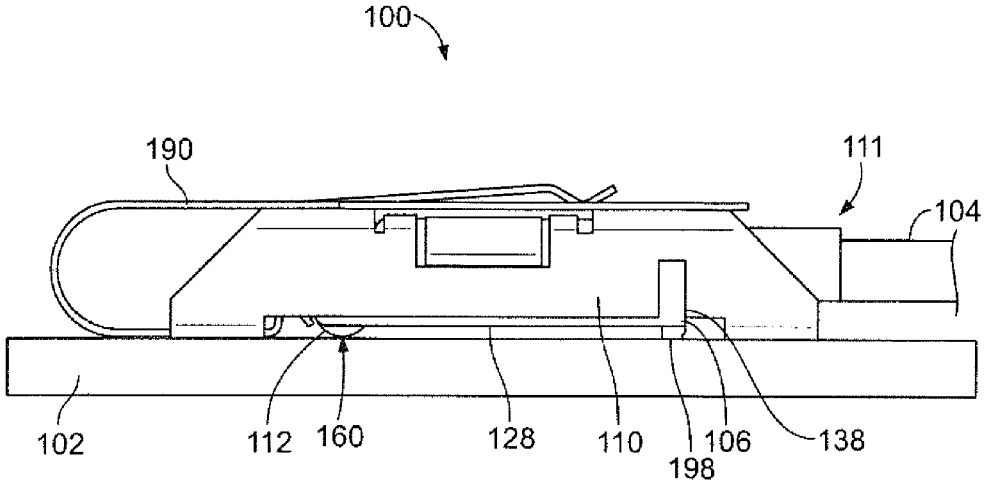
FIG. 9 is a side view of the coaxial cable assembly.
Figure 10:
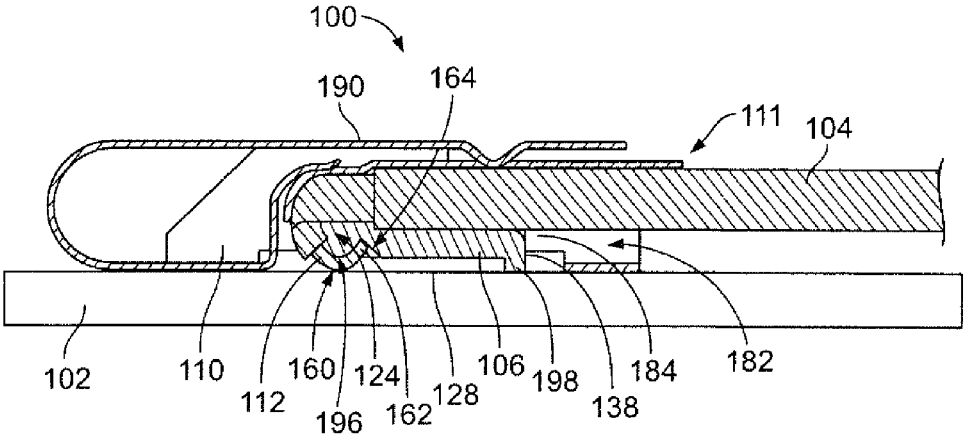
FIG. 10 is a cross sectional view of the coaxial cable assembly.

FIG. 9 is a side view of the coaxial cable assembly 100. FIG. 10 is a cross sectional view of the coaxial cable assembly 100. Once assembled, the cable subassembly 111 is held in the cavity 182 by the base shell 110. The cover 190 presses against a top of the cable subassembly 111 to hold the cable subassembly 111 within the cavity 182. The retention tabs 184 extend behind the cables housing 106 to hold the cable subassembly 111 within the cavity 182.

The coaxial cable assembly 100 is electrically connected to the circuit board 102. The exposed portion of the conductor 112 directly engages the circuit board 102. The coaxial cable 104 is wrapped around the nose 124. The end 162 of the conductor 112 is received in the well 164 and secured therein. The mating interface 160 is defined at the apex or lowest point of the conductor 112.

In an exemplary embodiment, the cable housing 106 includes a crown 196. The conductor 112 is bent around the crown 196 and is positioned for direct electrical connection with the circuit board 102. In an exemplary embodiment, the cable housing 106 includes a foot 198 proximate to the rear 138. The foot 198 positions the bottom 128 of the cable housing 106 along the circuit board 102. In an exemplary embodiment, the foot 198 is co-planar with the mating interface 160 for mounting to the circuit board 102.

Figure 11:
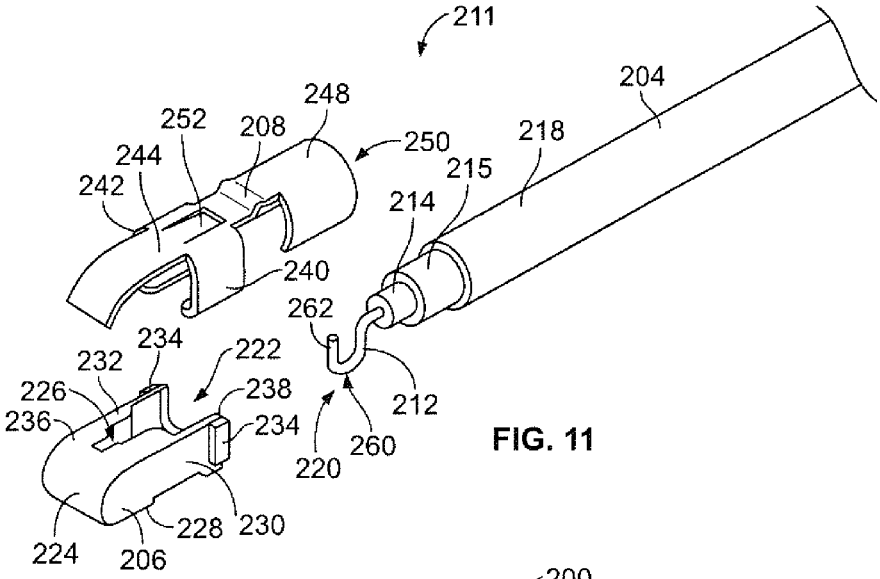
FIG. 11 is an exploded view of a cable subassembly formed in accordance with an exemplary embodiment.

FIG. 11 is an exploded view of a cable subassembly 211 formed in accordance with an exemplary embodiment. The cable subassembly 211 is used as part of a coaxial cable assembly 200 (shown in FIG. 12). The cable subassembly 211 is similar to the cable subassembly 111 (shown in FIG. 1), however the cable subassembly 211 includes a hooked end for the center wire that is held internal of the cable housing for direct electrical termination to a signal pad of a circuit board, as opposed to being wrapped around a front of a cable housing as with the cable subassembly 111.

Figure 12:
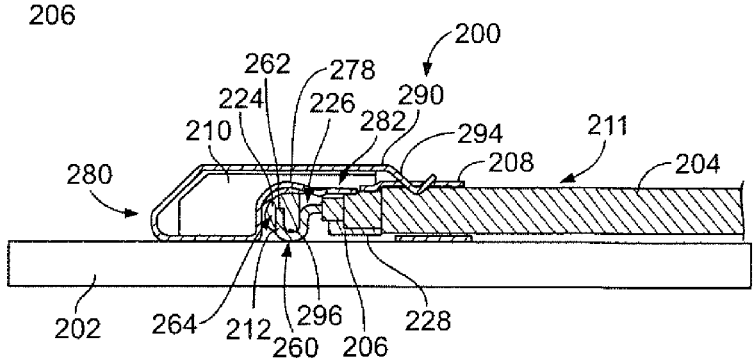
FIG. 12 is a cross sectional view of the coaxial cable assembly shown in FIG. 11.

FIG. 12 is a cross sectional view of the coaxial cable assembly 200. The coaxial cable assembly 200 is directly connected to a circuit board 202 without the need for an intermediary connector therebetween. The coaxial cable assembly 200 includes a coaxial cable 204, a cable housing 206, a cable shield 208 and a base shell 210. The coaxial cable 204, cable housing 206 and cable shield 208 define the cable subassembly 211 configured to be inserted into the base shell 210 to electrically terminate the coaxial cable 204 to the circuit board 202. The base shell 210 is mounted directly to the circuit board 202. The coaxial cable 204 is received in the cable housing 206 and the cable shield 208 is coupled to the cable housing 206 to provide electrical shielding for the coaxial cable 204.

Returning to FIG. 11, the coaxial cable 204 includes a conductor 212, an insulator 214 surrounding the conductor 212, an outer conductor 216 surrounding the insulator 214 and a jacket 218 surrounding the outer conductor 216. In an exemplary embodiment, the conductor 212 is defined by a center wire of the coaxial cable 204, and may be referred to hereinafter as a center wire 212. The center wire 212 is exposed at a terminating end 220 of the coaxial cable 204 for direct electrical connection to the circuit board 202 (shown in FIG. 12). The exposed portion of the center wire 212 is bent into a predetermined shape for loading into the cable housing 206 and for direct connection to the circuit board 202 at a separable mating interface. In an exemplary embodiment, the center wire 212 is bent into a hook shape. The exposed portion of the center wire 212 may be bent into a U-shape with the end extending generally perpendicular to a cable axis of the coaxial cable 204.

The cable housing 206 includes a cable channel 222 that receives the coaxial cable 204. The cable housing 206 includes a nose 224 at a front end of the cable housing 206. A conductor slot 226 is provided at the nose 224. Optionally, the conductor slot 226 may be open internally, and the front of the nose 224 may be closed in front of the conductor slot 226. The conductor slot 226 is an internal passage through the nose 224. The conductor slot 226 receives the center wire 212 and may receive a portion of the insulator 214. Optionally, the conductor slot 226 may receive a portion of the outer conductor 216. As shown in FIG. 12, during assembly, the exposed portion of the center wire 212 is hooked around a crown 296, which is defined by a surface of the conductor slot 226 interior of the nose 224. The crown 296 is located near a bottom 228 of the cable housing 206 and the crown 296 receives the U-shaped portion of the center wire 212. Optionally, the center wire 212 may be wrapped around the crown 296 during assembly, rather than being pre-bent. The cable housing 206 includes a well 264 forward of the crown 296 that receives an end 262 of the center wire 212. The end 262 may be secured within the well 264.

The cable housing 206 includes opposite sides 230, 232. The sides 230, 232 have catches 234 that extend outward therefrom. The catches 234 are used to secure the cable shield 208 to the cable housing 206. The sides 230, 232 extend to a top 236 of the cable housing 206. In an exemplary embodiment, the cable channel 222 is open through the top 236 such that the coaxial cable 204 may be loaded onto the cable channel 222 through the open top 236. Alternatively, the top 236 may be closed and the coaxial cable 204 may be loaded through a rear 238 of the cable housing 206.

The cable shield 208 is configured to be coupled to the cable housing 206. In an exemplary embodiment, the cable shield 208 is manufactured from a metal material, such as a copper material or another conductive material, to provide electrical shielding for the coaxial cable assembly 200. In an exemplary embodiment, the cable shield 208 may be a stamped and formed part. The cable shield 208 includes sides 240, 242 and a top 244 extending between the sides 240, 242. The sides 240, 242 extend along the sides 230, 232 to clip the cable shield 208 onto the cable housing 206. The catches 234 are positioned behind the sides 240, 242 to hold the cable shield 208 from sliding backwards off of the cable housing 206.

The cable shield 208 includes a strain relief 248 at a rear 250 of the cable shield 208. The cable shield 208 includes a spring finger 252 configured to engage the exposed portion of the outer conductor 216 when the cable shied 208 is coupled to the cable housing 206.

With reference to FIG. 12, the base shell 210 includes a spring lever 278 proximate to a front 280 of the base shell 210. A cavity 282 is defined by the base shell 210. The cavity 282 receives the cable subassembly 211. The spring lever 278 engages a top of the nose 224 to press the cable subassembly 211 downward into the circuit board 202. In an exemplary embodiment, the spring lever 278 engages the cable shield 208 to electrically connect the base shell 210 to the cable shield 208. In an exemplary embodiment, the spring lever 278 imparts a vertically downward force onto the cable subassembly 211 directly above the exposed portion of the center wire 212 to press the center wire 212 into the circuit board 202, such as into a signal pad of the circuit board 202. A compressible connection is made between the center wire 212 and the circuit board 202. The compression is imparted, at least in part, by the spring lever 278.

After the cable subassembly 211 is loaded into the cavity 282, the cover 290 is closed to hold the cable subassembly 211 in the cavity 282. The cover 290 includes a grounding finger 294 that is configured to be spring biased against the cable shield 208. The grounding finger 294 electrically couples the base shell 210 to the cable shield 208. The grounding finger 294 may impart a spring force against the top of the cable subassembly 211 to press the cable subassembly downward against the circuit board 202.

Figure 13:
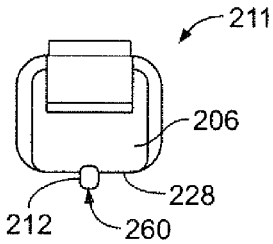
FIG. 13 is a front view of a cable subassembly for the coaxial cable assembly shown in FIG. 11.
Figure 14:
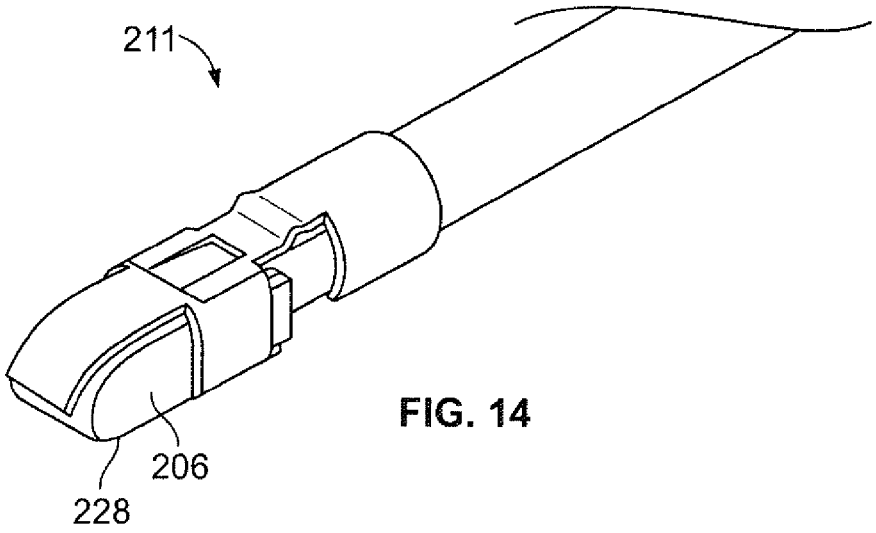
FIG. 14 is a front perspective view of the cable subassembly shown in FIG. 13.
Figure 15:
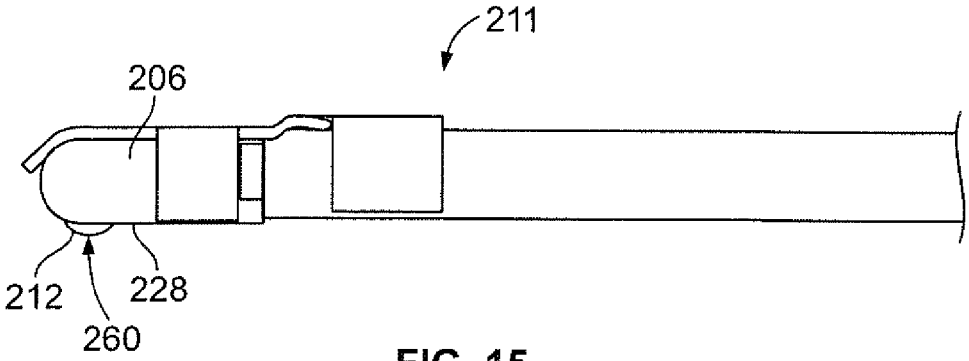
FIG. 15 is a side view of the cable subassembly shown in FIG. 13.
Figure 16:
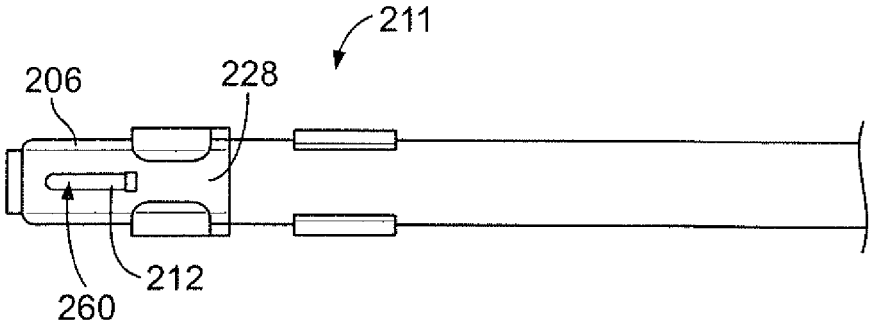
FIG. 16 is a bottom view of the cable subassembly shown in FIG. 13.

FIG. 13 is a front view of the cable subassembly 211 formed in accordance with an exemplary embodiment. FIG. 14 is a front perspective view of the cable subassembly 211, FIG. 15 is a side view of the cable subassembly 211. FIG. 16 is a bottom view of the cable subassembly 211. The conductor 212 is illustrated exposed along the bottom 228 of the cable housing 206 for direct electrical connection to the circuit board 202 (shown in FIG. 12).

The exposed portion of the conductor 212 includes a mating interface 260 at the apex of the exposed portion of the conductor 212. The mating interface 260 is configured to be compressed against the circuit board 202. The mating interface 260 is separable from the circuit board 202. The mating interface 260 makes an electrical connection directly to the circuit board 202 without a soldered connection therebetween. The mating interface 260 makes an electrical connection with the circuit board 202 without another component or interface therebetween, such as a contact or terminal therebetween. A single interface is defined between the center wire 212 and the signal pad of the circuit board 202.

Figure 17:
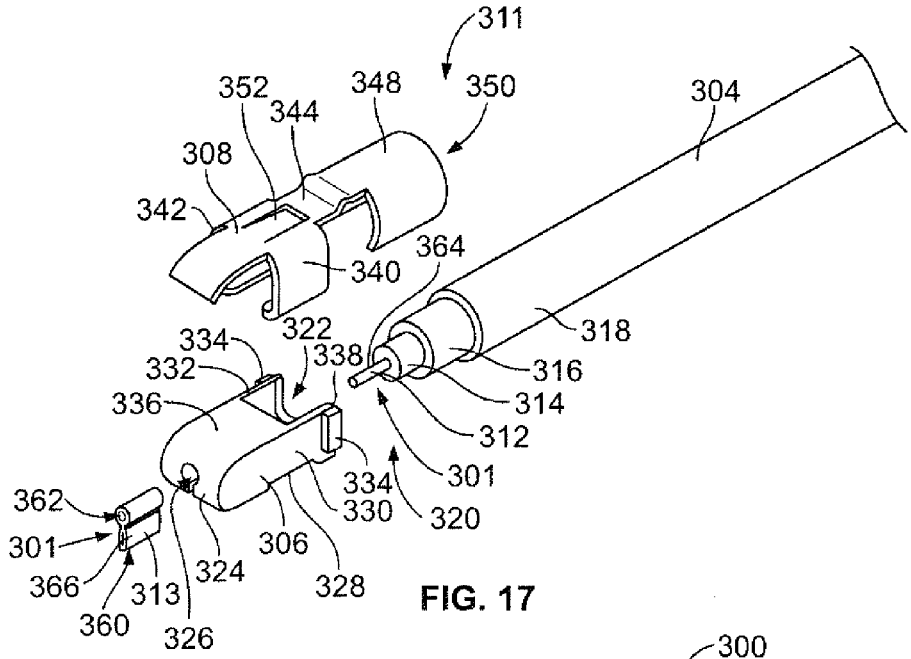
FIG. 17 is an exploded view of a cable subassembly formed in accordance with an exemplary embodiment.

FIG. 17 is an exploded view of a cable subassembly 311 formed in accordance with an exemplary embodiment. The cable subassembly 311 is used as part of a coaxial cable assembly 300 (shown in FIG. 18). The cable subassembly 311 is similar to the cable subassembly 111 (shown in FIG. 1), however the cable subassembly 311 includes a conductor 301 defined by both a center wire 312 and a wedge contact 313 that is held by the cable housing for direct electrical termination to a signal pad of a circuit board, as opposed to the conductor 112 (shown in FIG. 2) that is defined only by the center wire.

Figure 18:
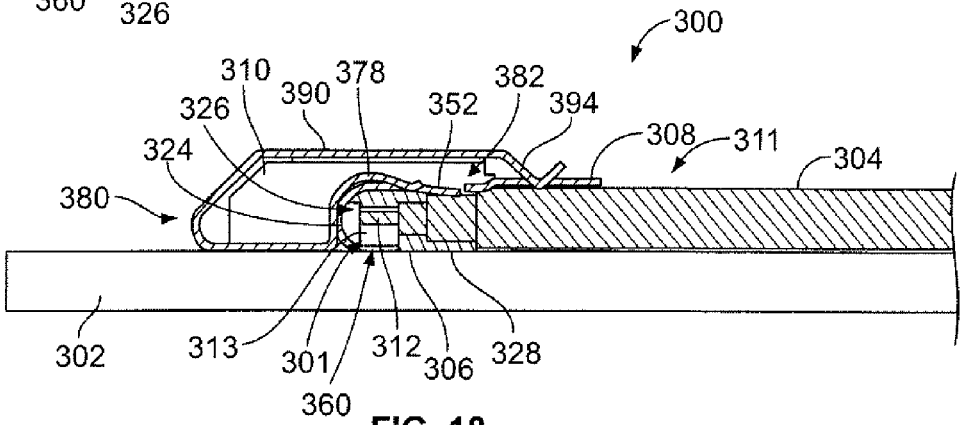
FIG. 18 is a cross sectional view of the coaxial cable assembly shown in FIG. 17.

FIG. 18 is a cross sectional view of the coaxial cable assembly 300. The coaxial cable assembly 300 is directly connected to a circuit board 302 without the need for an intermediary connector therebetween. The coaxial cable assembly 300 includes a coaxial cable 304, a cable housing 306, a cable shield 308 and a base shell 310. The coaxial cable 304, cable housing 306 and cable shield 308 define the cable subassembly 311 configured to be inserted into the base shell 310 to electrically terminate the conductor 301 to the circuit board 302. The base shell 310 is mounted directly to the circuit board 302. The coaxial cable 304 and wedge contact 313 are received in the cable housing 306 and the cable shield 308 is coupled to the cable housing 306 to provide electrical shielding for the coaxial cable 304 and wedge contact 313.

Returning to FIG. 17, the coaxial cable 304 includes the center wire 312, an insulator 314 surrounding the center wire 312, an outer conductor 316 surrounding the insulator 314 and a jacket 318 surrounding the outer conductor 316. The center wire 312 is exposed at a terminating end 320 of the coaxial cable 304 for direct electrical connection to the wedge contact 313. Optionally, the wedge contact 313 may be crimped to the center wire 312. Alternatively, the wedge contact 313 may be soldered or otherwise electrically and/or mechanically coupled to the center wire 312. The wedge contact 313 has a mating interface 360 defined at an end thereof that is configured to be directly electrically connected to the circuit board 302 (shown in FIG. 18). The wedge contact 313 has a wire barrel 362 that receives an end 364 of the center wire 312. The wedge contact 313 has a mating tab 366 that extends from the wire barrel 362. The end of the mating tab 366 defines the mating interface 360. Optionally, the wedge contact 313 may be stamped and formed. The wedge contact 313 may have a wedge shape for securing the wedge contact 313 in the cable housing 306 by an interference fit. The wedge contact 313 may have a wedge shape at the mating interface 360 to wedge the mating interface 360 against the circuit board 302 during loading of the cable subassembly 311 into the base shell 310.

The cable housing 306 includes a cable channel 322 that receives the coaxial cable 304. The cable housing 306 includes a nose 324 at a front end of the cable housing 306. A conductor slot 326 is provided at the nose 324. Optionally, the conductor slot 326 may be open at the front of the nose 324 for receiving the wedge contact 313 through the front. The conductor slot 326 may be open between the front and the cable channel 322 to allow the center wire 312 to pass through the conductor slot 326 form the cable channel 322 for terminating the wedge contact 313 to the center wire 312. The conductor slot 326 receives the center wire 312 and may receive a portion of the insulator 314. Optionally, the conductor slot 326 may receive a portion of the outer conductor 316.

The cable housing 306 includes opposite sides 330, 332. The sides 330, 332 have catches 334 that extend outward therefrom. The catches 334 are used to secure the cable shield 308 to the cable housing 306. The sides 330, 332 extend to a top 336 of the cable housing 306. In an exemplary embodiment, the cable channel 322 is open through the top 336 such that the coaxial cable 304 may be loaded onto the cable channel 322 through the open top 336. Alternatively, the top 336 may be closed and the coaxial cable 304 may be loaded through a rear 338 of the cable housing 306.

The cable shield 308 is configured to be coupled to the cable housing 306. In an exemplary embodiment, the cable shield 308 is manufactured from a metal material, such as a copper material or another conductive material, to provide electrical shielding for the coaxial cable assembly 300. In an exemplary embodiment, the cable shield 308 may be a stamped and formed part. The cable shield 308 includes sides 340, 342 and a top 344 extending between the sides 340, 342. The sides 340, 342 extend along the sides 330, 332 to clip the cable shield 308 onto the cable housing 306. The catches 334 are positioned behind the sides 340, 342 to hold the cable shield 308 from sliding backwards off of the cable housing 306.

The cable shield 308 includes a strain relief 348 at a rear 350 of the cable shield 308. The cable shield 308 includes a spring finger 352 configured to engage the exposed portion of the outer conductor 316 when the cable shied 308 is coupled to the cable housing 306.

With reference to FIG. 18, the base shell 310 includes a spring lever 378 proximate to a front 380 of the base shell 310. A cavity 382 is defined by the base shell 310. The cavity 382 receives the cable subassembly 311. The spring lever 378 engages a top of the nose 324 to press the cable subassembly 311 downward into the circuit board 302. In an exemplary embodiment, the spring lever 378 engages the cable shield 308 to electrically connect the base shell 310 to the cable shield 308. In an exemplary embodiment, the spring lever 378 imparts a vertically downward force onto the cable subassembly 311 directly above the wedge contact 313 to press the wedge contact 313 into the circuit board 302, such as into a signal pad of the circuit board 302. A compressible connection is made between the wedge contact 313 and the circuit board 302. The compression is imparted, at least in part, by the spring lever 378.

After the cable subassembly 311 is loaded into the cavity 382, the cover 390 is closed to hold the cable subassembly 311 in the cavity 382. The cover 390 includes a grounding finger 394 that is configured to be spring biased against the cable shield 308. The grounding finger 394 electrically couples the base shell 310 to the cable shield 308. The grounding finger 394 may impart a spring force against the top of the cable subassembly 311 to press the cable subassembly downward against the circuit board 302.

Figure 19:
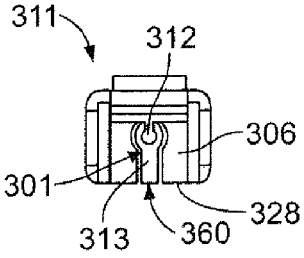
FIG. 19 is a front view of a cable subassembly of the coaxial cable assembly shown in FIG. 17.
Figure 20:
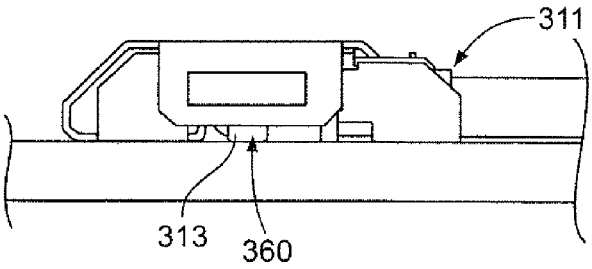
FIG. 20 is a side view of the cable subassembly shown in FIG. 19.

FIG. 19 is a front view of the cable subassembly 311 formed in accordance with an exemplary embodiment. FIG. 20 is a side view of the cable subassembly 311. The conductor 301 is illustrated exposed along the bottom 328 of the cable housing 306 for direct electrical connection to the circuit board 302 (shown in FIG. 20).

The wedge contact 313 defines the exposed portion of the conductor 301 that is configured to be compressed against the circuit board 302. The mating interface 360 is separable from the circuit board 302. The mating interface 360 makes an electrical connection directly to the circuit board 302 without a soldered connection therebetween. The mating interface 360 makes an electrical connection with the circuit board 302 without another component or interface therebetween, such as a mating contact or mating terminal therebetween. Only two interfaces are defined between the center wire 312 and the signal pad of the circuit board 302, namely the interface between the center wire 312 and the wedge contact 313 and the interface between the wedge contact 313 and the signal pad of the circuit board 302.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A coaxial cable assembly comprising:

a coaxial cable having a terminating end, a conductor being exposed at the terminating end;

a cable housing holding the coaxial cable, the cable housing having a conductor slot receiving the exposed conductor; and a cable shield coupled to the cable housing, the cable shield providing electrical shielding for the terminating end of the coaxial cable;

wherein the cable housing is configured to be coupled to a circuit board such that the exposed conductor directly engages a signal pad of the circuit board for electrical connection thereto.

2. The coaxial cable assembly of claim 1, wherein the conductor is configured to be directly coupled to the signal pad of the circuit board at a separable interface.

3. The coaxial cable assembly of claim 1, wherein the conductor comprises a center wire of the coaxial cable, the center wire being held within the conductor slot for directly engaging the signal pad.

4. The coaxial cable assembly of claim 1, wherein the conductor comprises a center wire of the coaxial cable and a wedge contact terminated to the center wire, the wedge contact being held within the conductor slot for directly engaging the signal pad.

5. The coaxial cable assembly of claim 1, wherein the cable housing includes a nose at an end of the cable housing, the conductor slot provided at the nose, the conductor being exposed at the nose for direct mounting to the signal pad.

6. The coaxial cable assembly of claim 1, wherein the cable housing is configured to be spring biased against the circuit board, the exposed conductor being compressed against the signal pad when the cable housing is coupled to the circuit board.

7. The coaxial cable assembly of claim 1, wherein the cable shield is electrically connected to an outer conductor of the coaxial cable.

8. The coaxial cable assembly of claim 1, wherein the cable housing includes a crown within the cable shield, the conductor comprising a center wire of the coaxial cable, the center wire being bent about the crown to define an apex configured to be compressed against the signal pad.

9. The coaxial cable assembly of claim 1, further comprising a base shell configured to be mounted to the circuit board, the base shell comprising a spring lever being spring biased against at least one of the cable housing and the cable shield to press the exposed conductor against the signal pad.

10. The coaxial cable assembly of claim 1, wherein the cable housing includes a bottom configured to face the circuit board.

11. A coaxial cable assembly comprising:

a base shell configured to be coupled to a circuit board over a signal pad of the circuit board, the base shell having a cavity;

a coaxial cable having a terminating end, a conductor being exposed at the terminating end;

a cable housing holding the coaxial cable, the cable housing having a conductor slot receiving the exposed conductor; and a cable shield coupled to the cable housing, the cable shield providing electrical shielding for the terminating end of the coaxial cable;

wherein the cable housing and cable shield are loaded into the cavity of the base shell, the base shell holding the cable housing such that the exposed conductor is configured to directly engage the signal pad of the circuit board for electrical connection thereto.

12. The coaxial cable assembly of claim 11, wherein the conductor is configured to be directly coupled to the signal pad of the circuit board at a separable interface.

13. The coaxial cable assembly of claim 11, wherein the conductor comprises a center wire of the coaxial cable, the center wire being held within the conductor slot for directly engaging the signal pad.

14. The coaxial cable assembly of claim 11, wherein the conductor comprises a center wire of the coaxial cable and a wedge contact terminated to the center wire, the wedge contact being held within the conductor slot for directly engaging the signal pad.

15. The coaxial cable assembly of claim 11, wherein the cable housing includes a nose at an end of the cable housing, the conductor slot provided at the nose, the conductor being exposed at the nose for direct mounting to the signal pad.

16. The coaxial cable assembly of claim 11, wherein the cable housing is configured to be spring biased against the circuit board, the exposed conductor being compressed against the signal pad when the cable housing is coupled to the circuit board.

17. A coaxial cable assembly comprising:

a coaxial cable having a terminating end, a conductor being exposed at the terminating end, the conductor comprising a center wire of the coaxial cable and the conductor comprising a wedge contact terminated to an end of the center wire;

a cable housing holding the coaxial cable, the cable housing having a conductor slot receiving the wedge contact; and a cable shield coupled to the cable housing, the cable shield providing electrical shielding for the terminating end of the coaxial cable;

wherein the cable housing is configured to be coupled to a circuit board such that the wedge contact directly engages a signal pad of the circuit board for electrical connection thereto.

18. The coaxial cable assembly of claim 17, wherein the cable housing includes a nose at an end of the cable housing, the conductor slot provided at the nose, the wedge contact being exposed at the nose for direct mounting to the signal pad.

19. The coaxial cable assembly of claim 17, wherein the cable housing is configured to be spring biased against the circuit board, the exposed wedge contact being compressed against the signal pad when the cable housing is coupled to the circuit board.

20. The coaxial cable assembly of claim 17, further comprising a base shell configured to be mounted to the circuit board, the base shell comprising a spring lever being spring biased against at least one of the cable housing and the cable shield to press the exposed wedge contact against the signal pad.

* * * * *